US009674598B2

(12) United States Patent
Prentice

(10) Patent No.: US 9,674,598 B2
(45) Date of Patent: Jun. 6, 2017

(54) AUDIO ACCESSORY COMMUNICATION WITH ACTIVE NOISE CANCELLATION

(71) Applicant: Fairchild Semiconductor Corporation, San Jose, CA (US)

(72) Inventor: Seth M. Prentice, Auburn, ME (US)

(73) Assignee: FAIRCHILD SEMICONDUCTOR CORPORATION, San Jose, CA (US)

( * ) Notice: Subject to any disclaimer, the term of this patent is extended or adjusted under 35 U.S.C. 154(b) by 171 days.

(21) Appl. No.: 14/639,629

(22) Filed: Mar. 5, 2015

(65) Prior Publication Data

US 2015/0296286 A1 Oct. 15, 2015

Related U.S. Application Data

(60) Provisional application No. 61/979,975, filed on Apr. 15, 2014.

(51) Int. Cl.

| | |
|---|---|
| ***H04R 1/10*** | (2006.01) |
| *G10L 21/0208* | (2013.01) |
| *G10L 21/0216* | (2013.01) |

(52) U.S. Cl.

CPC ..... *H04R 1/1083* (2013.01); *G10L 21/0208* (2013.01); *G10L 2021/02166* (2013.01); *H04R 1/1041* (2013.01)

(58) Field of Classification Search

CPC ..... H04R 1/1025
USPC ..... 381/71.6, 74, 384
See application file for complete search history.

(56) References Cited

U.S. PATENT DOCUMENTS

| | | | |
|---|---|---|---|
| 5,438,694 | A | 8/1995 | Muri et al. |
| 5,656,962 | A | 8/1997 | Banik |
| 5,703,529 | A | 12/1997 | Ghaffaripour et al. |
| 6,012,115 | A | 1/2000 | Chambers et al. |
| 6,198,416 | B1 | 3/2001 | Velazquez |
| 7,051,129 | B2 | 5/2006 | Horowitz et al. |
| 7,120,509 | B1 | 10/2006 | Filo et al. |
| 7,916,873 | B2 | 3/2011 | Villemoes et al. |
| 8,019,096 | B2 | 9/2011 | Sander et al. |
| 8,150,046 | B2 | 4/2012 | Hansson et al. |
| 8,155,337 | B2 | 4/2012 | Choi et al. |

(Continued)

FOREIGN PATENT DOCUMENTS

| | | | |
|---|---|---|---|
| CN | 1128587 | A | 8/1996 |
| CN | 1233800 | A | 11/1999 |

(Continued)

OTHER PUBLICATIONS

"U.S. Appl. No. 13/920,929, Notice of Allowance mailed Sep. 11, 2015", 13 pgs.

(Continued)

*Primary Examiner* — Joseph Saunders, Jr.
(74) *Attorney, Agent, or Firm* — Schwegman Lundberg Woessner, P.A.

(57) ABSTRACT

This document discusses, among other things, an advanced slave circuit and method configured to transfer power from a master device to a battery through an advanced slave circuit in a first mode using a load switch in a first state, to isolate the battery from the master device using the load switch in a second state, and to selectively couple a microphone to the master device using the advanced slave circuit in a second mode using a microphone switch.

20 Claims, 6 Drawing Sheets

(56) References Cited

U.S. PATENT DOCUMENTS

| | | | | |
|---|---|---|---|---|
| 8,254,592 | B2 | 8/2012 | Sander et al. | |
| 8,285,208 | B2 | 10/2012 | Terlizzi | |
| 8,831,234 | B2 | 9/2014 | Turner et al. | |
| 9,060,228 | B2 | 6/2015 | Lee et al. | |
| 9,253,564 | B2 | 2/2016 | Prentice | |
| 9,519,602 | B2 | 12/2016 | Prentice | |
| 2002/0118042 | A1 | 8/2002 | Helt et al. | |
| 2005/0027889 | A1 | 2/2005 | Sandulescu | |
| 2005/0273312 | A1 | 12/2005 | Sandulescu et al. | |
| 2007/0078544 | A1 | 4/2007 | Hsieh et al. | |
| 2007/0147640 | A1 | 6/2007 | Mottier et al. | |
| 2007/0256126 | A1 | 11/2007 | Erickson et al. | |
| 2008/0044004 | A1 | 2/2008 | Keehr | |
| 2008/0164994 | A1 | 7/2008 | Johnson et al. | |
| 2008/0298607 | A1 | 12/2008 | Wu et al. | |
| 2009/0180643 | A1 | 7/2009 | Sander et al. | |
| 2010/0119099 | A1* | 5/2010 | Haupt | G06F 3/165 381/369 |
| 2010/0215183 | A1 | 8/2010 | Hansson et al. | |
| 2011/0161532 | A1 | 6/2011 | Prentice et al. | |
| 2011/0163604 | A1 | 7/2011 | Hong et al. | |
| 2011/0286612 | A1 | 11/2011 | Cooper et al. | |
| 2012/0014530 | A1 | 1/2012 | Yamkovoy | |
| 2012/0019309 | A1 | 1/2012 | Turner et al. | |
| 2012/0121106 | A1 | 5/2012 | Henriksen | |
| 2012/0163614 | A1 | 6/2012 | Asada et al. | |
| 2012/0163634 | A1 | 6/2012 | Wu et al. | |
| 2012/0183160 | A1 | 7/2012 | Abe et al. | |
| 2013/0003995 | A1 | 1/2013 | Poulsen | |
| 2013/0035040 | A1 | 2/2013 | Terlizzi | |
| 2013/0156216 | A1 | 6/2013 | Shah et al. | |
| 2013/0158919 | A1 | 6/2013 | Shah et al. | |
| 2013/0329916 | A1 | 12/2013 | Breece, Iii et al. | |
| 2013/0336506 | A1 | 12/2013 | Prentice | |
| 2013/0343561 | A1 | 12/2013 | Johnson et al. | |
| 2014/0038460 | A1 | 2/2014 | Lee | |
| 2014/0055167 | A1 | 2/2014 | Oh et al. | |
| 2014/0079236 | A1* | 3/2014 | Yamkovoy | H04R 1/1025 381/71.6 |
| 2015/0043757 | A1 | 2/2015 | Prentice | |

FOREIGN PATENT DOCUMENTS

| | | | |
|---|---|---|---|
| CN | 2731837 | Y | 10/2005 |
| CN | 1893473 | A | 1/2007 |
| CN | 1928807 | A | 3/2007 |
| CN | 101211909 | A | 7/2008 |
| CN | 201204638 | Y | 3/2009 |
| CN | 101729958 | A | 6/2010 |
| CN | 101841754 | A | 9/2010 |
| CN | 102056072 | A | 5/2011 |
| CN | 103517184 | A | 1/2014 |
| CN | 103581787 | A | 2/2014 |
| CN | 203435132 | U | 2/2014 |
| CN | 105049970 | A | 11/2015 |
| DE | 102010049654 | A1 | 6/2011 |
| JP | 2012510215 | A | 4/2012 |
| KR | 1020110046361 | A | 5/2011 |
| KR | 1020120015265 | A | 2/2012 |
| KR | 1020140018103 | A | 2/2014 |
| KR | 101374074 | B1 | 3/2014 |
| KR | 1020150118904 | A1 | 10/2015 |

OTHER PUBLICATIONS

"U.S. Appl. No. 13/920,929, Response filed Jun. 17, 2015 to Restriction Requirement mailed May 5, 2015", 9 pgs.
"U.S. Appl. No. 14/453,109, Non Final Office Action mailed Jun. 11, 2015", 20 pgs.
"U.S. Appl. No. 14/453,109, Response filed Sep. 10, 2015 to Non Final Office Action mailed Jun. 11, 2015", 12 pgs.
"U.S. Appl. No. 12/650,144 , Response filed Mar. 7, 2013 to Final Office Action mailed Jan. 7, 2013", 12 pgs.
"U.S. Appl. No. 12/650,144, Advisory Action mailed Feb. 9, 2012", 3 pgs.
"U.S. Appl. No. 12/650,144, Advisory Action mailed Apr. 8, 2013", 3 pgs.
"U.S. Appl. No. 12/650,144, Examiner Interview Summary mailed Oct. 3, 2012", 3 pgs.
"U.S. Appl. No. 12/650,144, Final Office Action mailed Jan. 7, 2013", 26 pgs.
"U.S. Appl. No. 12/650,144, Final Office Action mailed Dec. 2, 2011", 19 pgs.
"U.S. Appl. No. 12/650,144, Non Final Office Action mailed Jun. 13, 2012", 32 pgs.
"U.S. Appl. No. 12/650,144, Non Final Office Action mailed May 13, 2011", 16 pgs.
"U.S. Appl. No. 12/650,144, Response filed Feb. 2, 2012 to Final Office Action mailed Dec. 2, 2011", 9 pgs.
"U.S. Appl. No. 12/650,144, Response filed Mar. 2, 2012 to Advisory Action mailed Feb. 9, 2012", 9 pgs.
"U.S. Appl. No. 12/650,144, Response filed Aug. 15, 2011 to Non Final Office Action mailed May 13, 2011", 11 pgs.
"U.S. Appl. No. 12/650,144, Response filed Oct. 12, 2012 to Non Final Office Action mailed Jun. 13, 2012", 14 pgs.
"U.S. Appl. No. 13/188,778, Final Office Action mailed Mar. 6, 2014", 15 pgs.
"U.S. Appl. No. 13/188,778, Non Final Office Action mailed Sep. 10, 2013", 18 pgs.
"U.S. Appl. No. 13/188,778, Notice of Allowance mailed May 30, 2014", 8 pgs.
"U.S. Appl. No. 13/188,778, Response filed Feb. 10, 2014 to Non Final Office Action mailed Sep. 10, 2013", 14 pgs.
"U.S. Appl. No. 13/188,778, Response filed May 6, 2014 to Final Office Action mailed Mar. 6, 2014", 11 pgs.
"U.S. Appl. No. 13/915,150, Advisory Action mailed Jan. 7, 2015", 3 pgs.
"U.S. Appl. No. 13/915,150, Examiner Interview Summary mailed Dec. 15, 2014", 3 pgs.
"U.S. Appl. No. 13/915,150, Final Office Action mailed Oct. 29, 2014", 13 pgs.
"U.S. Appl. No. 13/915,150, Non Final Office Action mailed Jun. 5, 2014", 12 pgs.
"U.S. Appl. No. 13/915,150, Notice of Allowance mailed Feb. 23, 2015", 15 pgs.
"U.S. Appl. No. 13/915,150, Response filed Jan. 29, 2015 to Final Office Action mailed Oct. 29, 2014", 10 pgs.
"U.S. Appl. No. 13/915,150, Response filed Aug. 27, 2014 to Non Final Office Action mailed Jun. 5, 2014", 9 pgs.
"U.S. Appl. No. 13/915,150, Response filed Dec. 12, 2014 to Final Office Action mailed Oct. 29, 2014", 10 pgs.
"U.S. Appl. No. 13/920,929, Restriction Requirement mailed May 5, 2015", 7 pgs.
"Chinese Application Serial No. 201110209513.X, Office Action mailed Feb. 8, 2014", w/English Translation, 9 pgs.
"Chinese Application Serial No. 201110209513.X, Office Action mailed Oct. 10, 2014", w/English Translation, 6 pgs.
"Chinese Application Serial No. 201110209513.X, Response filed Jun. 17, 2014 to Office Action mailed Feb. 8, 2014", w/English Translation, 35 pgs.
"Chinese Application Serial No. 201110209513.X,Response filed Jan. 26, 2015 to Office Action mailed Oct. 10, 2014", w/ English Translation, 15 pgs.
"Chinese Application Serial No. 201420441716.0, Office Action mailed Oct. 22, 2014", w/English Translation, 3 pgs.
"Chinese Application Serial No. 201420441716.0, Response filed Oct. 24, 2014 to Office Action mailed Oct. 22, 2014", w/English Claims, 33 pgs.
"U.S. Appl. No. 13/920,929, PTO Response to Rule 312 Communication mailed Dec. 24, 2015", 2 pgs.
"U.S. Appl. No. 14/453,109, Non Final Office Action mailed Feb. 3, 2016", 15 pgs.
"U.S. Appl. No. 14/453,109, Response filed May 3, 2016 to Non Final Office Action mailed Feb. 3, 2016", 10 pgs.
"Chinese Application Serial No. 201310241342.8, Office Action mailed Dec. 3, 2015"w/ English Translation, 9 pgs.

(56) References Cited

OTHER PUBLICATIONS

"Chinese Application Serial No. 201310241342.8, Response filed Apr. 18, 2016 to Office Action mailed Dec. 3, 2015" w/ English Claims , 7 pgs.
"Chinese Application Serial No. 201310336787.4, Office Action mailed Feb. 14, 2016", W/ English Translation, 10 pgs.
"Chinese Application Serial No. 201310336787.4, Response filed Jun. 28, 2016 to Office Action mailed Feb. 14, 2016" w/ English Claims, 19 pgs.
"U.S. Appl. No. 13/920,929, 312 Amendment filed Dec. 9, 2015", 7 pgs.
"U.S. Appl. No. 14/453,109, Notice of Allowability mailed Sep. 6, 2016", 2 pgs.
"U.S. Appl. No. 14/453,109, Notice of Allowance mailed Aug. 12, 2016", 8 pgs.
"Chinese Application Serial No. 201310241342.8, Office Action mailed Aug. 8, 2016", 6 pgs.
"Chinese Application Serial No. 201310241342.8, Response filed Oct. 24, 2016 to Office Action mailed Aug. 8, 2016", 25 pgs.
"Chinese Application Serial No. 201310336787.4, Office Action mailed Sep. 18, 2016", W/ English Translation, 8 pgs.
"Chinese Application Serial No. 201310336787.4, Response filed Nov. 24, 2016 to Office Action mailed Sep. 18, 2016", 16 pgs.
"Chinese Application Serial No. 201320349079.X, Response filed Oct. 28, 2013", 5 pgs.
"Chinese Office Action Application Serial No. 201310241342.8, Office Action mailed Nov. 25, 2016", 3 pgs.
"Korean Application Serial No. 10-2011-0073717 Amendment filed Jul. 25, 2016", 2 pgs.
"Korean Application Serial No. 10-2011-0073717, Office Action mailed Nov. 15, 2016", with English translation of claims, 7 pgs.
"Korean Application Serial No. 10-2011-0073717, Response filed Jan. 13, 2017 to Office Action mailed Nov. 15, 2016", (English Translation of Claims), 12 pgs.
"Korean Application Serial No. 10-2013-0082479, Notice of Allowance mailed May 19, 2015", 3 pgs.

* cited by examiner

AUDIO ACCESSORY COMMUNICATION WITH ACTIVE NOISE CANCELLATION

CLAIM OF PRIORITY

This application claims the benefit of priority under 35 U.S.C. §119(e) of U.S. Provisional Patent Application Ser. No. 61/979,975, titled "AUDIO ACCESSORY COMMUNICATION WITH ACTIVE NOISE CANCELLATION," filed on Apr. 15, 2014, which is incorporated by reference herein in its entirety.

BACKGROUND

Mobile electronic devices include standard connectors configured to send or receive information or power to or from one or more accessories or other electronic devices. An example standard connector includes an audio jack, including left and right audio connections, a ground connection, and a microphone connection. In certain examples, an audio jack accessory, such as a mobile headset, can be configured to communication to or from the mobile electronic device using the microphone connection of the audio jack.

OVERVIEW

This document discusses, among other things, an advanced slave circuit and method configured to transfer power from a master device to a battery through an advanced slave circuit in a first mode using a load switch in a first state, to isolate the battery from the master device using the load switch in a second state, and to selectively couple a microphone to the master device using the advanced slave circuit in a second mode using a microphone switch.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present inventors have recognized, among other things, audio jack authentication systems and methods to identify and verify audio jack accessories coupled to an audio jack of a mobile device, ensuring that mobile device users are provided vendor-known audio jack accessory quality and full system features. Audio jack microphone (MIC) connections currently provide voice and key press features. As such features depend on the type or model of audio jack accessory, in certain examples, the audio jack accessory must be identified prior to enabling full bi-directional communication.

Many audio jack accessories include features that require power, such as active noise cancellation (ANC), haptic feedback, etc. Accordingly, audio jack accessories can include a supplemental power source, such as a battery. The present inventors have recognized that, if the mobile device identifies the audio jack accessory as having or requiring power, in certain examples, the mobile device can provide additional power to either power the audio jack accessory or charge the a battery of the audio jack accessory using, for example, a microphone line or one or more other audio jack connections.

Figure 1:
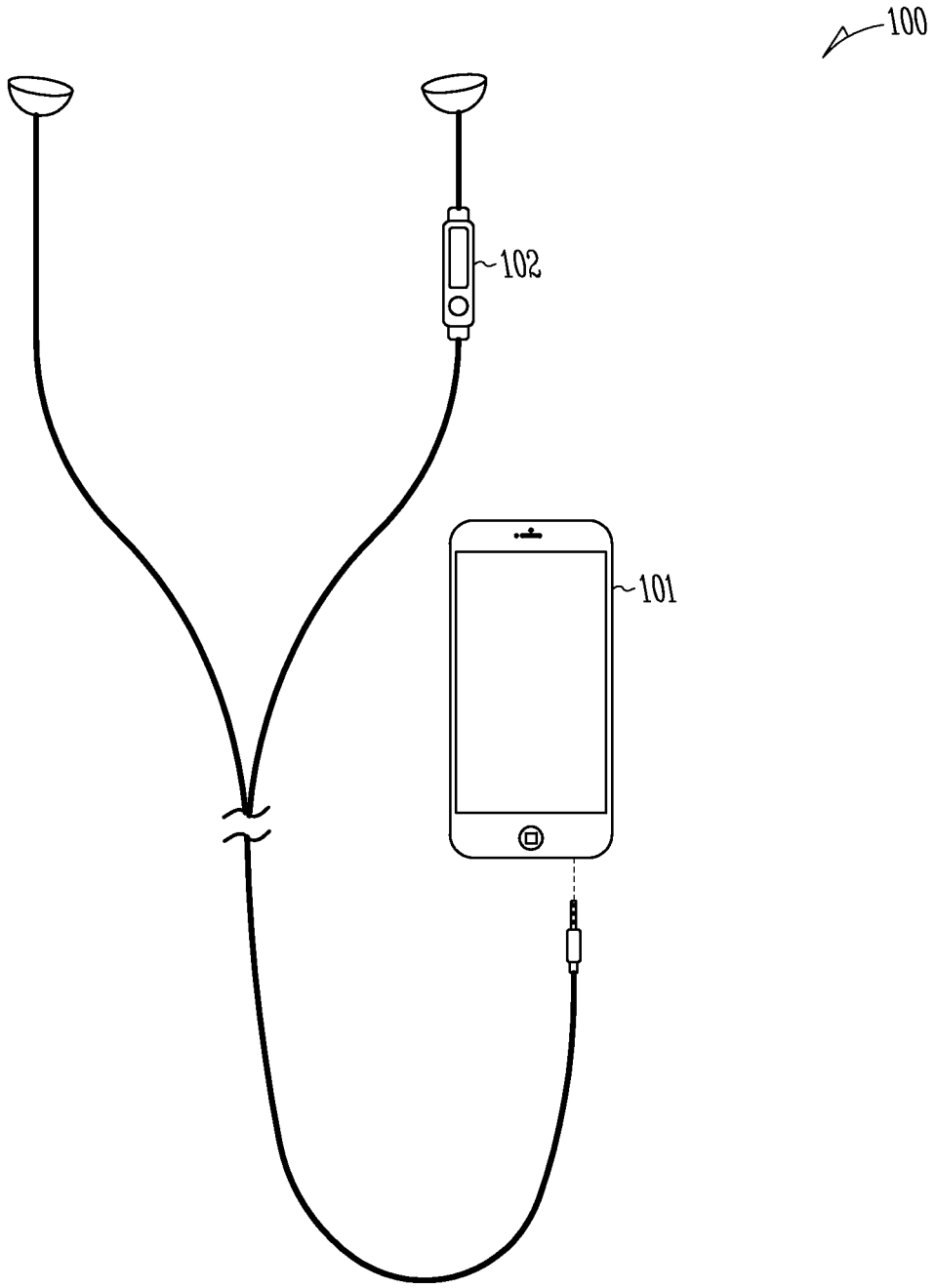
FIGS. 1-2 illustrates generally example audio jack authentication and communication systems.

FIG. 1 illustrates generally an example audio jack authentication and communication system 100 including a master device 101 (e.g., a mobile electronic device) and an accessory slave device 102 (e.g., a headset). In an example, the accessory slave device 102 can be coupled to an audio jack of the master device 101 using an audio jack plug. In an example, the accessory slave device 102 can include a microphone, left and right speakers, and one or more user-inputs (e.g., keys, such as a send/end key, one or more volume control keys, etc.) and ambient noise cancelling (ANC) circuitry. In certain examples, the ANC circuitry can require power. Accordingly, the accessory slave device 102 can include a battery.

The present inventors have recognized systems and methods to provide power to the accessory slave device 102 from a master device 101, for example, when a microphone or speaker of the accessory slave device 102 is not in use (e.g., for communication, etc.) to, among other things, power or charge a battery of the accessory slave device 102. In various examples, the systems and methods described herein can reduce the required accessory slave device battery size or capacity, reduce the cost of the accessory slave device 102, prolong the use of the accessory slave device 102 between traditional charging periods.

Figure 2:
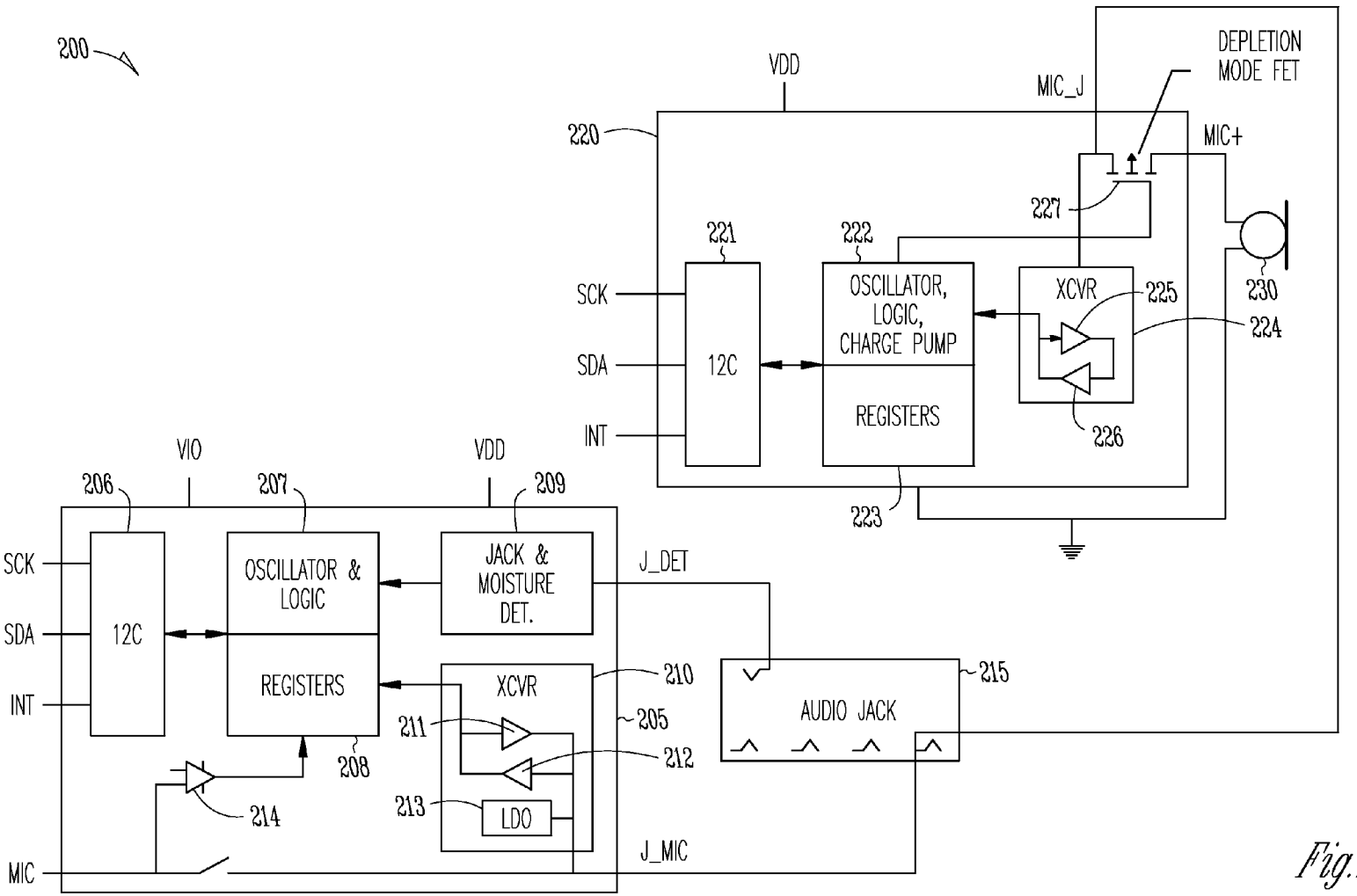

FIG. 2 illustrates generally an example audio jack authentication and communication system 200 including a master device circuit 205, an audio jack 215, an advanced slave circuit 220, and a microphone 230. In an example, the master device circuit 205 and the advanced slave circuit 220 are configured as a half-duplex interface for bi-directional communication between a master device including the master device circuit 205 and an advanced slave including the advanced slave circuit 220 through the audio jack 215.

The master device circuit 205 can include an inter-integrated circuit (I2C) interface 206, an oscillator and logic circuit 207, one or more registers 208, a transceiver (XCVR) 210, and a comparator 114. The transceiver 210 can include first and second drivers 211, 212 and a low-dropout (LDO) regulator 213.

In an example, the audio jack 215 can include left and right audio pins, a ground pin, and a microphone pin (J_MIC). In certain examples, the master device circuit 205 can include a jack and moisture detection circuit 209, and the audio jack 215 can include a dedicated connection pin (J_DET) to, for example, detect when an audio jack plug is fully inserted into an audio jack receptacle, or to detect moisture or one or more other contaminant or false plug in the audio jack receptacle. In certain examples, the jack and moisture detection circuit 209 can have a reduced printed circuit board (PCB) area (e.g., WLCSP 9-ball, etc.) and can provide pop or click reduction or isolation when an audio jack plug is removed from or inserted into the audio jack receptacle.

The advanced slave circuit 220 includes an I2C interface 221, an oscillator and logic circuit 222, one or more registers 223, a transceiver (XCVR) 224 including first and second drivers 225, 226, and a depletion mode switch 227 (e.g., a field effect transistor (FET)).

In an example, the master device or the advanced slave can include a microphone (MIC) switch configured to isolate signals to or from the MIC input of the master device or signals to or from the microphone 230 coupled to the advanced slave circuit 220, for example, to reduce or isolate an audible pop or click during switching or communication. In an example, the depletion mode switch 227 can provide backwards compatibility with prior or existing systems.

In certain examples, the advanced slave can include an identifier, such as a fuse-programmable ID or one or more other identifiers. The fuse programmable ID can include, for example, a 6-bit code capable of providing 64 unique possible IDs. Accordingly, in this example, 64 unique advanced slave accessories can be identified, with different operations/functions assigned to or associated with each.

In an example, the master device circuit 205 and the advanced slave circuit 220 can communicate to identify one or both of the master device or the advanced slave, such as disclosed in the commonly assigned U.S. application Ser. No. 14/453,109, "AUDIO JACK SYSTEM," to inventor Seth M. Prentice, filed on Aug. 6, 2014, included by reference in its entirety, including exchanging information between a master and slave device via a single conductive path of an audio jack connector using a digital communication protocol.

For a simple slave, the LDO 213 can supply power, and, in certain examples, no external supply is required. However, for certain advanced slaves, such as for advanced slaves having ambient noise cancellation circuitry, more power can be required.

Figure 3:
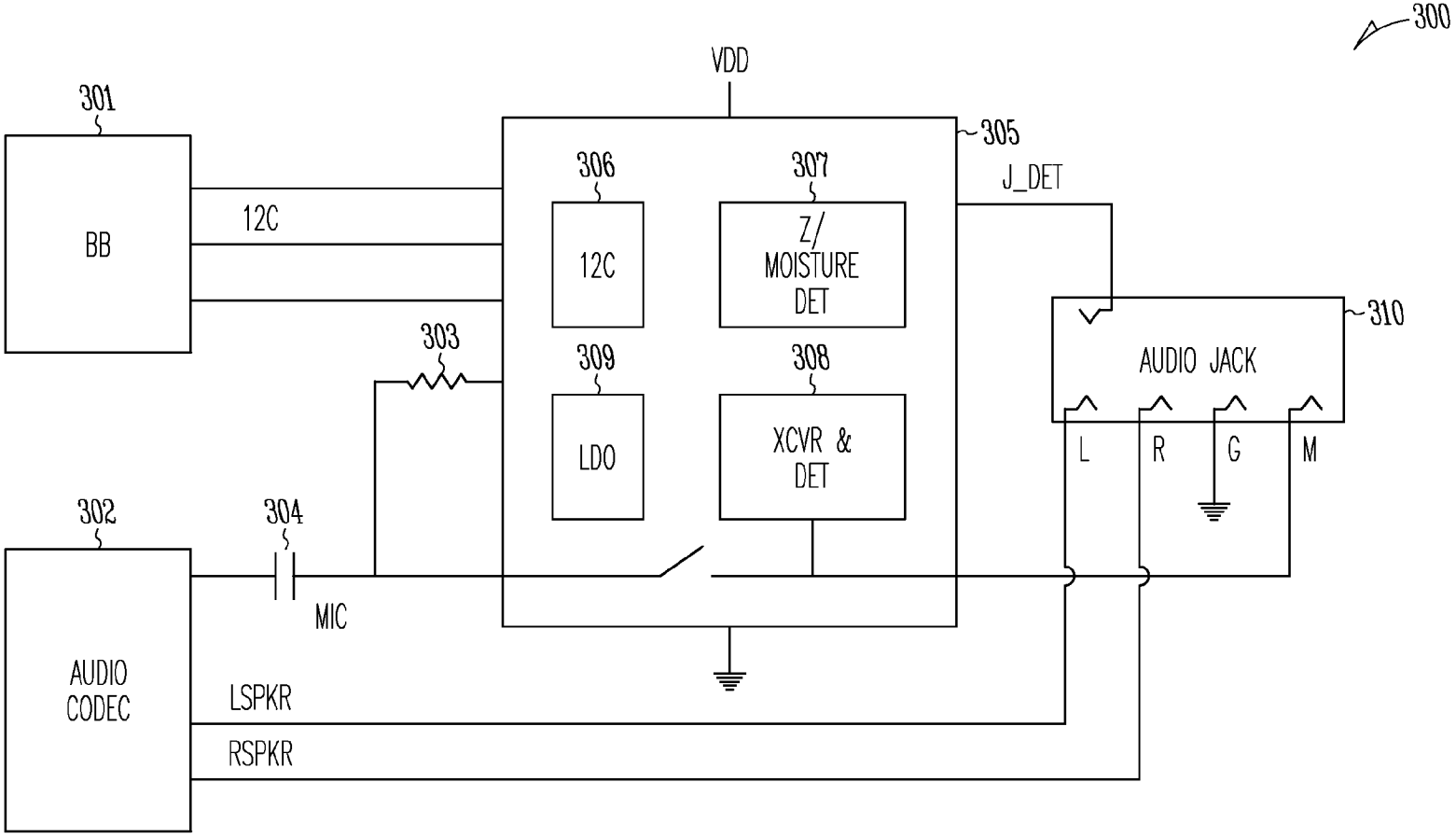
FIG. 3 illustrates generally an example mobile phone system.

FIG. 3 illustrates generally an example mobile phone system 300 including a baseband processor 301, an audio codec 302, a master device circuit 305, and an audio jack 310 configured to receive an audio jack plug and send or receive information to or from or otherwise provide power to or otherwise communicate with a slave device.

In an example, the master device circuit 305 can include an I2C interface 306, an impedance and moisture detection circuit (Z/MOISTURE DET) 307, a transceiver and detection circuit (XCVR & DET) 308, and an LDO circuit 309. In an example, the audio codec 302 can send or receive left and right audio information (LSPKR and RSPKR, respectively) to or from the left and right audio pins (L, R) of the audio jack 310, and microphone information (MIC) to or from the audio jack 310 through the master device circuit 305, for example, through a capacitor 304 or a resistor 303.

Figure 4:
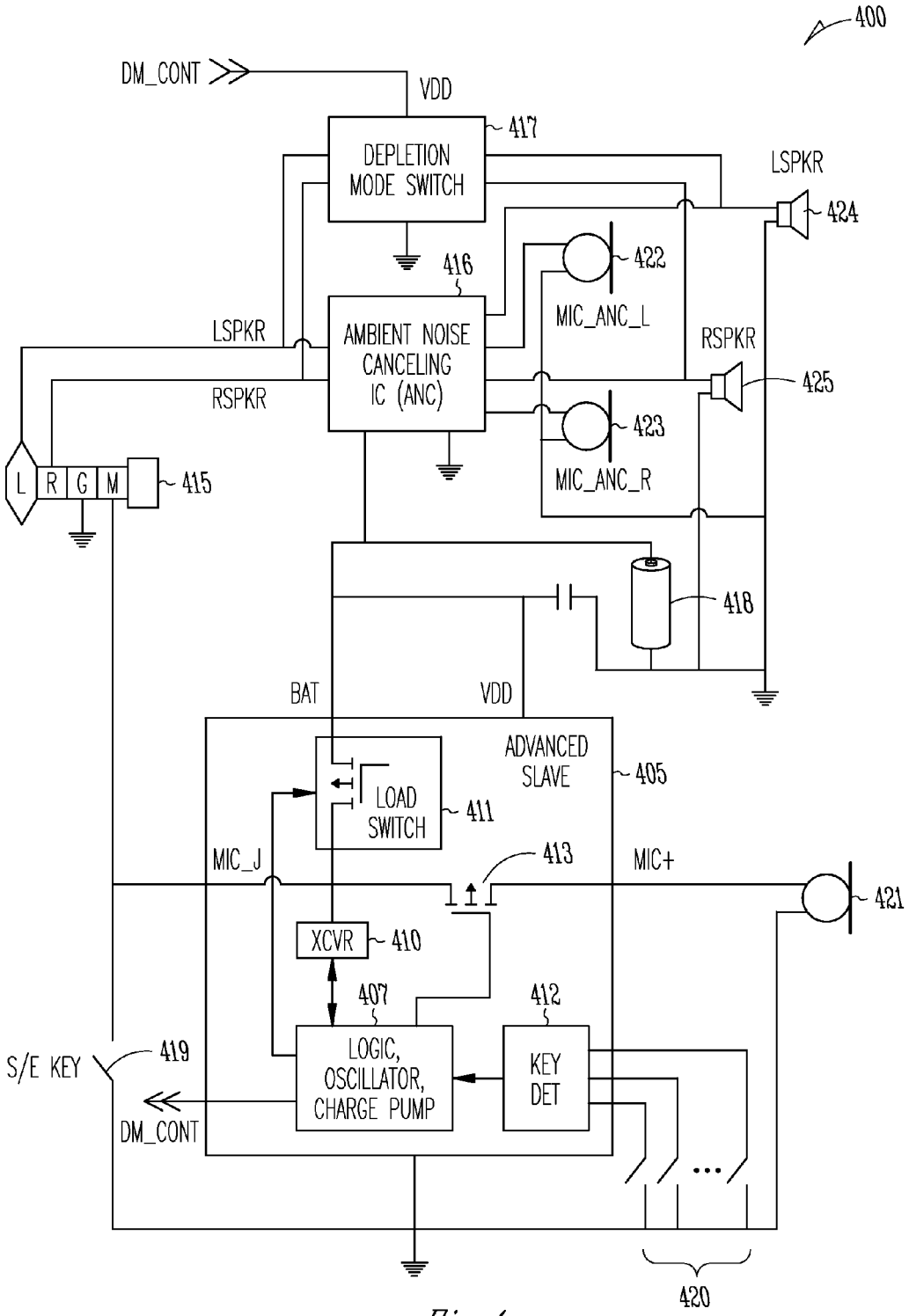
FIG. 4 illustrates generally an example headset system.

FIG. 4 illustrates generally an example headset system 400 including an advanced slave circuit 405, an audio jack plug 415, an ambient noise cancelling (ANC) integrated circuit (IC) 416, a depletion mode switch 417, a battery 418, a send/end key (S/E KEY) 419, one or more additional slave keys 420, a microphone 421, left and right ANC microphones (MIC_ANC_L, MIC_ANC_R) 422, 423, and left and right speakers (LSPKR, RSPKR) 424, 425.

In an example, the audio jack plug can include four pins: a left audio pin (L), a right audio pin (R), a ground pin (G), and a microphone (MIC) pin (M). In certain examples, the left and right audio pins can be reversed, one or more other pins can be in one or more other configurations, or the audio jack plug can include more or less than four pins.

The advanced slave circuit 405 includes a logic, oscillator, and charge pump circuit configured to control one or more components of the headset system 400 (e.g., the depletion mode switch 417, etc.) and a transceiver 410 coupled to the microphone pin. The advanced slave can further include a key detection circuit 412 coupled to the one or more slave keys 420, and a depletion mode switch 413 between the microphone pin of the audio jack plug 415 and the microphone 421. A key press on the one or more slave keys 420 can be detected by the key detection circuit 412 and communicated to the master device through a one-wire interface, such as a MIC line. In an example, the depletion mode switch 413 can be configured to isolate the microphone 421 during this time.

The depletion mode switch 417 and send/end key 419 can allow the headset system 400 to be backwards compatible with existing master devices. For example, if the audio jack plug 415 is coupled to a master device that is not configured for bi-directional one-wire communication, instead only configured for traditional microphone and speaker headset functions, then the headset system 400 will appear as a traditional headset, with the left and right audio pins coupled through the depletion mode switch 417 to the left and right speakers 424, 425, respectively, and the microphone pin coupled to the microphone 421 (e.g., through a depletion mode switch 413 in the advanced slave circuit 405), and to ground through the send/end key 419.

However, if the headset system 400 is coupled to a master device configured for bi-directional one-wire communication, such as illustrated in FIGS. 2 and 3, or other master devices the advanced features of the headset system 400 (e.g., ANC, additional key press, charging via an audio jack pin, etc.) may be used. Example functions of the headset system 400 can be described with respect to two modes: an audio mode; and a voice mode. In certain examples, the baseband processor of a master device can control when the headset system 400 is in audio mode or voice mode. Example audio modes include providing music or other audio over the left and right speakers 424, 425. Example voice modes include during incoming or outgoing voice communication, when receiving voice commands, etc.

In an example audio mode, the microphone pin of the audio jack plug 415 can receive a MIC bias from the master device. The advanced slave circuit 405, in audio mode, can be configured to provide power to the ANC IC 416 and, in certain examples, charge the battery 418, such as using the MIC bias through a load switch 411. In an example, the advanced slave circuit 405 can be configured to receive instructions from the master device (e.g., from a baseband processor of a mobile phone, etc.), and to control the load switch 411 (e.g., using the logic, oscillator, charge pump 407, etc.) in accordance with the instructions from the master device. In other examples, the advanced slave circuit 405 can be configured to receive information from a user, such as using the send/end key 419 or the one or more slave keys. In an example, the advanced slave circuit 405 can transmit the received information to the master device and wait to receive return instructions, or can control one or more components of the headset system 400 directly in accordance with the received information.

In an example, the load switch 411 can include a true reverse-current blocking load switch having a max current limit to protect any coupled devices or to optimize the current through the switch provided to the battery 418. In other examples, additional circuitry can be included in the load switch 411, in the advanced slave circuit 405, or between the load switch 411 and the battery 418 to optimize the received power to charge the battery 418 or to power the ANC IC 416 or one or more other circuits or components of the headset system 400. In certain examples, to save power, when the battery 418 is fully charged and the ANC IC 416 is not in use, the advanced slave 405 can communicate to the master device to remove power from the MIC line, or one or more other lines providing power to the headset system 400.

In an example voice mode, the advanced slave circuit 405 can receive a communication (e.g., from the baseband processor in the master device) to connect the microphone 421 to the MIC line, receive an audio signal from the microphone 421, and provide the received audio signal, or one or more other key detection or other signals, to the master device. In the example voice mode, the ANC IC 416 can be powered by the battery 418. The battery 418 can be sized to support a long call (e.g., 2 hours, etc.). If a voltage of the battery 418 is below a threshold (e.g., when the battery is drained below a level that can support operation of the ANC IC 416, when the battery is missing, etc.), the depletion mode switch 417 can route the left and right audio signals from the audio jack plug 415 around the ANC IC 416 to the left and right speakers 424, 425, to maintain basic functionality of the headset system 400 without ANC. Further, if the advanced slave circuit 405 cannot be powered, the depletion mode switch 413 couples the microphone 421 to the microphone pin of the audio jack plug 415. When the example voice mode is complete, the baseband processor can communicate to the advanced slave to isolate the microphone 421, and audio mode, including charging the battery 418, can resume.

Figure 5:
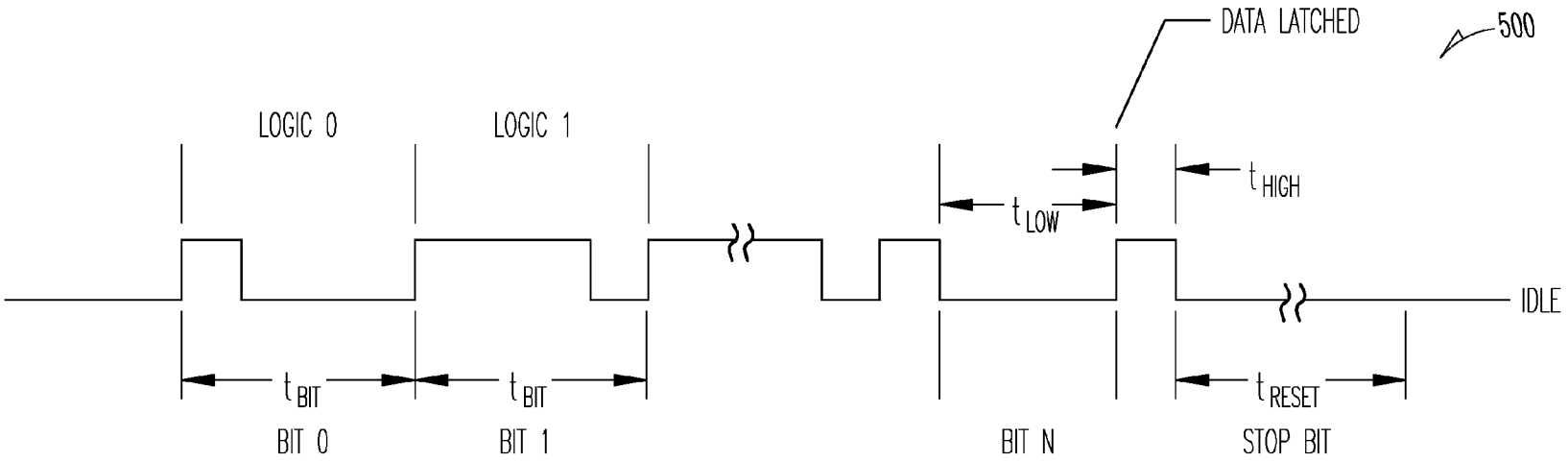
FIG. 5 illustrates generally example single-wire communication.

FIG. 5 illustrates generally example single-wire communication 500 (e.g., TinyWire™, etc.) between a master device and an advanced slave device. In an example, a short bit low is logic 1, and a long bit low is logic 0. A transmission frequency can be between 200 and 400 KHz. A complete master/slave transaction time (e.g., 400 Khz) can be less than 51 ms (e.g., 50 ms for master MIC switch slow tON for reduced pop and click). The signal amplitude can include the master internal LDO amplitude—500 mV (e.g., master internal LDO=2.8V). In certain examples, other amplitudes can be used for pair matching, depending on observed conditions or simulations. Example data words can include 12 bits in total: 2-bit address; 6-bit data; 1-bit parity (e.g., error detection); and 3-bit reserve. In other examples, data words of other bit sizes can be used.

Figure 6:
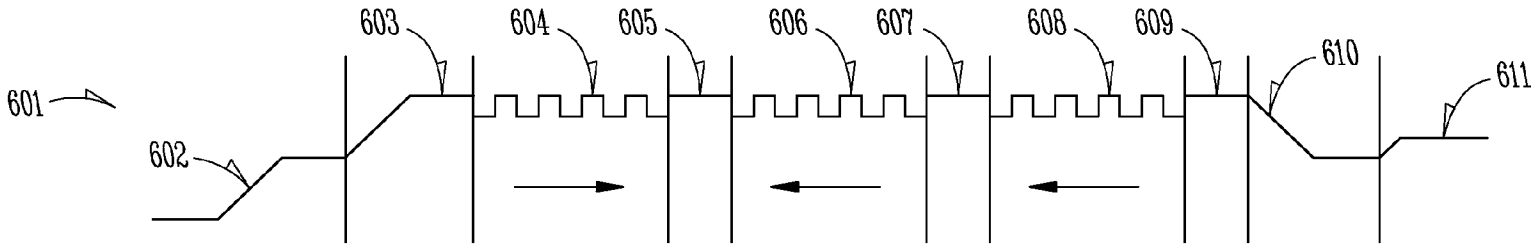
FIGS. 6-8 illustrate generally example device authentication signals.
Figure 7:
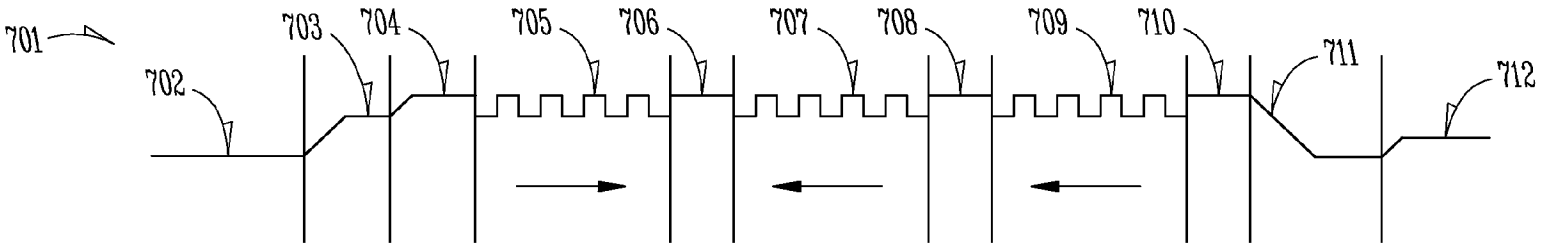
Figure 8:
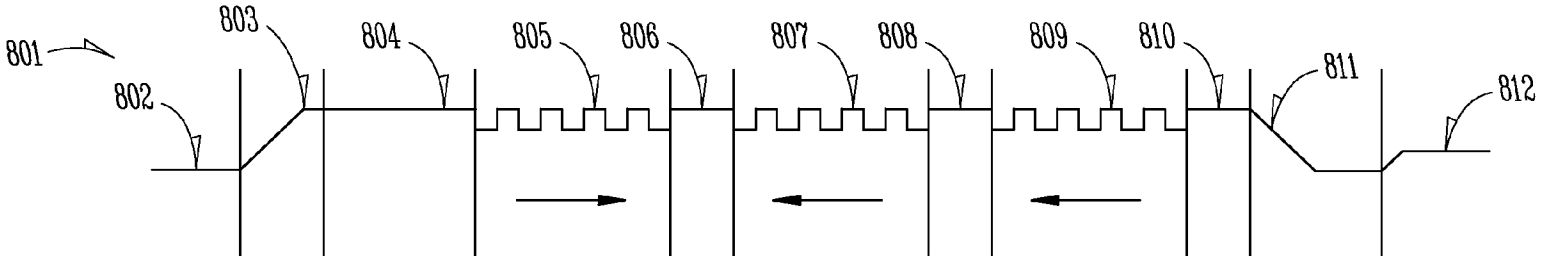

FIGS. 6-8 illustrate generally example device authentication signals, including: at FIG. 6, an example device authentication signal transmission 601; at FIG. 7, a slave write (e.g., key press) signal transmission 701; and, at FIG. 8, a master write (e.g., volume up) signal transmission 801.

FIG. 6 illustrates generally an example device authentication signal transmission 601. At 602, a master device bypasses a bias resistor. In certain examples, the master device can also isolate a single conductive path from a baseband processor or an audio processor, for example, using a microphone switch. At 603, a slave can isolate a microphone from a single conductive path (e.g., a MIC line), for example, using an isolation switch. In certain examples, the slave can detect a change in the voltage on the single conductive path using an optional bias voltage detection circuit. At 604, the master device can detect if the voltage on the single conductive path has reached a threshold and can transit a verification code to the slave device over the single conductive path. At 605, a first predetermined minimum delay is implemented. At 606, the slave device can transmit an identification (ID) code to the master device over the single conductive path. At 607, a second predetermined minimum delay is implemented. At 608, the master device can transmit a power-down code to the slave device over the single conductive path. At 609, a third predetermined minimum delay is implemented. At 610, the slave device can couple the microphone to the single conductive path. At 611, after detecting the connected microphone via the voltage on the single conductive path, the master device can couple the single conductive path to the baseband processor or an audio processor, and can disable a bypass transistor to couple the bias source to the single conductive path through the bias resistor.

FIG. 7 illustrates generally an example slave write (e.g., key press) signal transmission 701. In certain examples, the slave write signal transmission can occur when a parameter in a master device is updated by a slave device, when the slave device requests an update from the master device, when the slave device communicates an event to the master device (e.g., a key-press event, etc.), or combinations thereof.

At 702, the slave device can isolate a microphone from a single conductive path. At 703, the master device can detect a change in voltage level resulting from the isolation of the microphone and can isolate the single conductive path from the baseband processor or audio processor. At 704, the master device can bypass a microphone bias resistor using a transistor. At 705, the master device can detect if the voltage on the single conductive path has reached a threshold and can transit a verification code to the slave device over the single conductive path. At 706, a first predetermined minimum delay is implemented. At 707, the slave device can transmit the event information to the master. At 708, a second predetermined minimum delay is implemented. At 709, the master device can transmit a power down code to the slave device. At 710, a third predetermined minimum delay is implemented. At 711, the slave device can couple the microphone to the single conductive path. At 712, after detecting the connected microphone via the voltage on the single conductive path, the master device can couple the single conductive path to the baseband processor or an audio processor, and can disable a bypass transistor to couple the bias source to the single conductive path through the bias resistor.

FIG. 8 illustrates generally an example master write (e.g., volume up) signal transmission 801. At 802, a master device can bypass a bias resistor using a bypass transistor. At 803, the master device can isolate a single conductive path from a baseband process or an audio processor, for example, using a microphone switch. At 804, the slave device can isolate a microphone from the single conductive path, for example, using an isolation switch, if the microphone is not already isolated from the single conductive path. In certain examples, the slave device can detect a change in the voltage on the single conductive path that results from the master device bypassing the bias resistor using an optional bias voltage detection circuit. At 805, the master device can detect if the voltage on the single conductive path has reached a threshold and can transmit a write code to the slave device over the single conductive path. At 806, a first predetermined minimum delay is implemented. At 807, the slave device can transmit an acknowledgment to the master device over the single conductive path. At 808, a second predetermined minimum delay is implemented. At 809, the master device can transmit write data to the slave device over the single conductive path. At 810, a third predetermined minimum delay is implemented. At 811, the slave device can couple the microphone to the single conductive path. At 812, after detecting the connected microphone via the voltage on the single conductive path, the master device can couple the single conductive path to the baseband processor or an audio processor, and can disable a bypass transistor to couple the bias source to the single conductive path through the bias resistor.

Although, as described above, power is provided to an accessory slave device using a microphone line of an audio jack when the microphone is not in use, in other examples, power can be provided to the accessory slave device using one or more other lines of the audio jack, such as the left or right audio lines, when not in use, in accordance with the teachings above.

EXAMPLES

In Example 1, an accessory headset system, includes an advanced slave circuit configured to communicate with a master device using a first connection of an audio jack, an ambient noise cancelling (ANC) circuit configured to receive a left audio signal from a second connection of the audio jack and a right audio signal from a third connection of the audio jack, to receive ambient noise information, and to provide corrected left and right audio signals using the left and right audio signals and the ambient noise information, and a battery configured to provide power to the ambient noise cancelling circuit. The advanced slave circuit is configured to receive power from the master device using the first connection of the audio jack in a first mode, and to selectively couple a microphone to the master device using the first connection of the audio jack in a second mode, wherein the advanced slave circuit includes: a load switch configured to provide power to the battery through the first connection of the audio jack in a first state, and to isolate the battery from the first connection of the audio jack in a second state; and a microphone switch configured to couple the microphone to the first connection of the audio jack in a first state, and to isolate the microphone from the first connection of the audio jack in a second state.

In Example 2, the system of Example 1 optionally includes the audio jack, the microphone, and the master device, wherein the first connection of the audio jack optionally includes a microphone connection coupled to the advanced slave circuit, wherein the second connection of the audio jack optionally includes a left audio connection coupled to the ANC circuit, wherein the third connection of the audio jack optionally includes a right audio connection coupled to the ANC circuit, and wherein the master device optionally includes a mobile phone.

In Example 3, the system of any one or more of Examples 1-2 optionally includes a first ANC microphone and a second ANC microphone, wherein the ANC circuit is configured to receive ambient noise information from the first and second ANC microphones.

In Example 4, the first mode of the advanced slave circuit of any one or more of Examples 1-3 optionally includes an audio mode, wherein the microphone switch is in the second state when the advanced slave circuit is in the audio mode, and wherein the second mode of the advanced slave circuit of any one or more of Examples 1-3 optionally includes a voice mode, wherein the microphone switch is in the first state when the advanced slave circuit is in the voice mode.

In Example 5, the load switch of any one or more of Examples 1-4 is optionally in the second state when the advanced slave circuit is in the voice mode.

In Example 6, the system of any one or more of Examples 1-5 optionally includes a send/end key coupled between the first connection of the audio jack and a ground connection, wherein the send/end key is configured to receive a user request and to provide an indication of the user request to the master device, and a depletion mode switch coupled to the second and third connections of the audio jack, wherein, when the advanced slave circuit is in the second mode and the battery voltage falls below a low-power threshold, the depletion mode switch is in a closed state, bypassing the ANC circuit.

In Example 7, the load switch of any one or more of Examples 1-6 is optionally configured to provide power to the ANC circuit through the first connection of the audio jack in the first state, and to isolate the ANC circuit from the first connection of the audio jack in the second state.

In Example 8, an apparatus includes an advanced slave circuit configured to communicate with a master device using a first connection of an audio jack, wherein the advanced slave circuit is configured to receive power from the master device using the first connection of the audio jack in a first mode, and to selectively couple a microphone to the master device using the first connection of the audio jack in a second mode, wherein the advanced slave circuit includes: a load switch configured to provide power to a battery coupled to the advanced slave circuit through the first connection of the audio jack in a first state, and to isolate the battery from the first connection of the audio jack in a second state; and a microphone switch configured to couple the microphone to the first connection of the audio jack in a first state, and to isolate the microphone from the first connection of the audio jack in a second state.

In Example 9, the first connection of the audio jack of any one or more of Examples 1-8 optionally includes a microphone connection.

In Example 10, the first mode of the advanced slave circuit of any one or more of Examples 1-9 optionally includes an audio mode, wherein the microphone switch is in the second state when the advanced slave circuit is in the audio mode, and the second mode of the advanced slave circuit of any one or more of Examples 1-9 optionally includes a voice mode, wherein the microphone switch is in the first state when the advanced slave circuit is in the voice mode.

In Example 11, the load switch of any one or more of Examples 1-10 is optionally in the second state when the advanced slave circuit is in the voice mode.

In Example 12, the advanced slave circuit of any one or more of Examples 1-11 is optionally configured to control the load switch and the microphone switch.

In Example 13, the load switch of any one or more of Examples 1-12 is optionally configured to provide power to an ambient noise cancelling (ANC) circuit through the first connection of the audio jack in the first state, and to isolate the ANC circuit from the first connection of the audio jack in the second state.

In Example 14, a method includes transferring power from a master device to a battery through an advanced slave circuit in a first mode using a load switch in a first state, isolating the battery from the master device using the load switch in a second state, and selectively coupling a microphone to the master device using the advanced slave circuit in a second mode using a microphone switch.

In Example 15, the transferring power of any one or more of Examples 1-14 optionally includes receiving power from the master device at the advanced slave circuit using a first connection of an audio jack and providing power to the battery coupled to the advanced slave circuit using the first connection of the audio jack through the load switch in the first state, wherein selectively coupling the microphone to the master device optionally includes coupling a microphone to the first connection of the audio jack using the microphone switch in a first state and isolating the microphone from the first connection of the audio jack using the microphone switch in a second state.

In Example 16, the first connection of the audio jack of any one or more of Examples 1-15 optionally includes a microphone connection.

In Example 17, the first mode of the advanced slave circuit of any one or more of Examples 1-16 optionally includes an audio mode, and the second mode of the advanced slave circuit optionally includes a voice mode, wherein isolating the battery from the master device optionally includes when the advanced slave circuit is in the audio mode, and wherein selectively coupling the microphone to the master device optionally includes coupling the microphone to a first connection of an audio jack using the microphone switch when the advanced slave circuit is in the voice mode.

In Example 18, the isolating the battery from the master device of any one or more of Examples 1-17 optionally includes when the advanced slave circuit is in the voice mode.

In Example 19, any one or more of Examples 1-18 optionally includes controlling the load switch and the microphone switch using the advanced slave circuit.

In Example 20, any one or more of Examples 1-19 optionally includes transferring power to an ambient noise cancelling (ANC) circuit from the master device through the advanced slave circuit in the first mode using the load switch in the first state and isolating the ANC circuit from the master device using the load switch in the second state.

In Example 21, a system or apparatus can include, or can optionally be combined with any portion or combination of any portions of any one or more of Examples 1-20 to include, means for performing any one or more of the functions of Examples 1-20, or a machine-readable medium including instructions that, when performed by a machine, cause the machine to perform any one or more of the functions of Examples 1-20.

Additional Notes

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, the code can be tangibly stored on one or more volatile or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. An accessory headset system, comprising:

an advanced slave circuit configured to communicate with a master device using a first connection of an audio jack;

an ambient noise cancelling (ANC) circuit configured to receive a left audio signal from a second connection of the audio jack and a right audio signal from a third connection of the audio jack, to receive ambient noise information, and to provide corrected left and right audio signals using the left and right audio signals and the ambient noise information; and a battery configured to provide power to the ambient noise cancelling circuit, wherein the advanced slave circuit is configured to receive power from the master device using the first connection of the audio jack in a first mode, and to selectively couple a microphone to the master device using the first connection of the audio jack in a second mode, wherein the advanced slave circuit includes:

a load switch configured to provide power to the battery through the first connection of the audio jack in a first load state, and to isolate the battery from the first connection of the audio jack in a second load state; and a microphone switch configured to couple the microphone to the first connection of the audio jack in a first microphone state, and to isolate the microphone from the first connection of the audio jack in a second microphone state.

2. The system of claim 1, including the audio jack, the microphone, and the master device, wherein the first connection of the audio jack includes a microphone connection coupled to the advanced slave circuit, wherein the second connection of the audio jack includes a left audio connection coupled to the ANC circuit, wherein the third connection of the audio jack includes a right audio connection coupled to the ANC circuit, and wherein the master device includes a mobile phone.

3. The system of claim 1, including:

a first ANC microphone; and a second ANC microphone, wherein the ANC circuit is configured to receive ambient noise information from the first and second ANC microphones.

4. The system of claim 1, including:

a send/end key coupled between the first connection of the audio jack and a ground connection, wherein the send/end key is configured to receive a user request and to provide an indication of the user request to the master device; and a depletion mode switch coupled to the second and third connections of the audio jack, wherein, when the advanced slave circuit is in the second mode and the battery voltage falls below a low-power threshold, the depletion mode switch is in a closed state, bypassing the ANC circuit.

5. The system of claim 1, wherein the load switch is configured to provide power to the ANC circuit through the first connection of the audio jack in the first load state, and to isolate the ANC circuit from the first connection of the audio jack in the second load state.

6. The system of claim 1, wherein the first mode of the advanced slave circuit includes an audio mode, wherein the microphone switch is in the second microphone state when the advanced slave circuit is in the audio mode, and wherein the second mode of the advanced slave circuit includes a voice mode, wherein the microphone switch is in the first microphone state when the advanced slave circuit is in the voice mode.

7. The system of claim 6, wherein the load switch is in the second load state when the advanced slave circuit is in the voice mode.

8. An apparatus, comprising:

an advanced slave circuit configured to communicate with a master device using a first connection of an audio jack, wherein the advanced slave circuit is configured to receive power from the master device using the first connection of the audio jack in a first mode, and to selectively couple a microphone to the master device using the first connection of the audio jack in a second mode, wherein the advanced slave circuit includes:

a load switch configured to provide power to a battery coupled to the advanced slave circuit through the first connection of the audio jack in a first load state, and to isolate the battery from the first connection of the audio jack in a second load state; and a microphone switch configured to couple the microphone to the first connection of the audio jack in a first microphone state, and to isolate the microphone from the first connection of the audio jack in a second microphone state.

9. The apparatus of claim 8, wherein the first connection of the audio jack includes a microphone connection.

10. The apparatus of claim 8, wherein the load switch is configured to provide power to an ambient noise cancelling (ANC) circuit through the first connection of the audio jack in the first load state, and to isolate the ANC circuit from the first connection of the audio jack in the second load state.

11. The apparatus of claim 8, wherein the first mode of the advanced slave circuit includes an audio mode, wherein the microphone switch is in the second microphone state when the advanced slave circuit is in the audio mode, and wherein the second mode of the advanced slave circuit includes a voice mode, wherein the microphone switch is in the first microphone state when the advanced slave circuit is in the voice mode.

12. The apparatus of claim 11, wherein the load switch is in the second load state when the advanced slave circuit is in the voice mode.

13. The apparatus of claim 11, wherein the advanced slave circuit is configured to control the load switch and the microphone switch.

14. A method, comprising:

transferring power from a master device to a battery through an advanced slave circuit in a first mode using a load switch in a first load state;

isolating the battery from the master device using the load switch in a second load state; and selectively coupling a microphone to the master device using the advanced slave circuit in a second mode using a microphone switch, wherein transferring power includes:

receiving power from the master device at the advanced slave circuit using a first connection of an audio jack; and providing power to the battery coupled to the advanced slave circuit using the first connection of the audio jack through the load switch in the first load state, and wherein selectively coupling the microphone to the master device includes:

coupling a microphone to the first connection of the audio jack using the microphone switch in a first microphone state; and isolating the microphone from the first connection of the audio jack using the microphone switch in a second microphone state.

15. The method of claim 14, wherein the first connection of the audio jack includes a microphone connection.

16. The method of claim 14, including controlling the load switch and the microphone switch using the advanced slave circuit.

17. The method of claim 14, wherein the first mode of the advanced slave circuit includes an audio mode, and the second mode of the advanced slave circuit includes a voice mode, wherein isolating the battery from the master device includes when the advanced slave circuit is in the audio mode, and wherein selectively coupling the microphone to the master device includes coupling the microphone to a first connection of an audio jack using the microphone switch when the advanced slave circuit is in the voice mode.

18. The method of claim 17, wherein isolating the battery from the master device includes when the advanced slave circuit is in the voice mode.

19. The method of claim 14, including:

transferring power to an ambient noise cancelling (ANC) circuit from the master device through the advanced slave circuit in the first mode using the load switch in the first load state; and isolating the ANC circuit from the master device using the load switch in the second load state.

20. The method of claim 19, including:

receiving a user request and providing an indication of the user request to the master device using a send/end key coupled between the first connection of the audio jack and a ground connection;

when the advanced slave circuit is in the second mode and the battery voltage falls below a low-power threshold, bypassing an active noise cancelling circuit (ANC) circuit using a depletion mode switch in a closed state.

* * * * *